US007438615B2

(12) United States Patent
Arvidsson

(10) Patent No.: US 7,438,615 B2
(45) Date of Patent: Oct. 21, 2008

(54) OUTBOARD DRIVE FOR BOATS

(75) Inventor: Lennart Arvidsson, Kållered (SE)

(73) Assignee: AB Volvo, Gothenburg (SE)

( * ) Notice: Subject to any disclaimer, the term of this patent is extended or adjusted under 35 U.S.C. 154(b) by 20 days.

(21) Appl. No.: 11/579,917

(22) PCT Filed: May 28, 2004

(86) PCT No.: PCT/SE2004/000827

§ 371 (c)(1),
(2), (4) Date: Nov. 8, 2006

(87) PCT Pub. No.: WO2005/115835

PCT Pub. Date: Dec. 8, 2005

(65) Prior Publication Data

US 2007/0270053 A1 Nov. 22, 2007

(51) Int. Cl.
*B63H 21/14* (2006.01)

(52) U.S. Cl. ..... 440/89 R; 440/58; 440/112

(58) Field of Classification Search ..... 440/53, 440/58–60, 61 S, 89 R, 111, 112
See application file for complete search history.

(56) References Cited

U.S. PATENT DOCUMENTS 2,307,781 A * 1/1943 Holloman et al. ..... 114/144 R
4,998,496 A 3/1991 Shaw
5,178,566 A * 1/1993 Stojkov et al. ..... 440/75
5,327,848 A 7/1994 Hannon
5,370,564 A * 12/1994 Fujimoto et al. ..... 440/89 R
5,964,174 A 10/1999 Coggan
6,280,270 B1 8/2001 Neisen
6,431,928 B1 * 8/2002 Aarnivuo ..... 440/58
6,468,120 B1 10/2002 Hasl et al.
7,186,157 B2 * 3/2007 Mansson et al. ..... 440/89 R

* cited by examiner

*Primary Examiner*—Sherman Basinger
(74) *Attorney, Agent, or Firm*—WRB-IP LLP

(57) ABSTRACT

Outboard drive for boats, including a gear housing, an underwater housing connected rotatably to the gear housing, and a mounting element arranged between the gear housing and the underwater housing for mounting the drive in a boat hull with the gear housing on the inside and the underwater housing on the outside of the hull and including an exhaust passage with an exhaust outlet. The exhaust outlet is surrounded by a plate made of polytetrafluoroethylene fixed on the underside of the mounting element. The underwater housing is rotatable relative to the gear housing by an electric servomotor communicating with a control computer, which communicates with an engine control computer for an internal combustion engine connected to the drive and is arranged so as, when the engine is shut off, to give a signal to the servomotor to put the underwater housing in a position corresponding to moving straight ahead.

20 Claims, 1 Drawing Sheet

OUTBOARD DRIVE FOR BOATS

Figure 1:
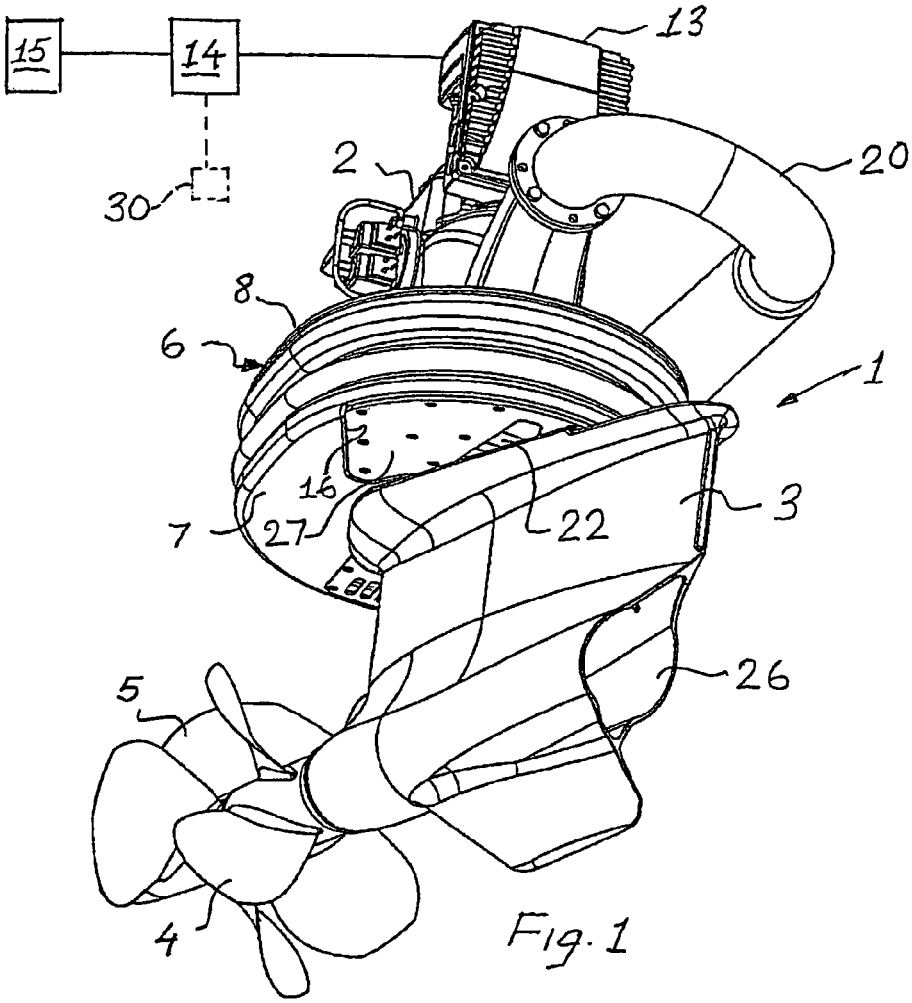

The present invention relates to an outboard drive for boats for driving at least one propeller, comprising a gear housing, an underwater housing connected rotatably to the gear housing, mounting means arranged between the gear housing and the underwater housing for mounting the drive in a boat hull with the gear housing on the inside and the underwater housing on the outside of the hull and comprising an exhaust passage, which has an exhaust outlet opening into an exhaust inlet to an exhaust passage in the underwater housing, and power-operated means which are connected to an electronic control unit and by means of which the underwater housing is rotatable relative to the gear housing and the mounting means depending on control commands fed into the control unit.

Outboard drives of the kind indicated above are known, for example from SE-A-522 187. Compared with the more common stem-mounted outboard drives, it is characteristic of these drives that the underwater housing cannot, as in the case of the former drives, be tipped up out of the water, for example when the boat is left stationary for a relatively long time. They are consequently more susceptible to fouling by organisms in the water, for example acorn barnacles. Underwater housings made of cast metal, in particular bronze, which are used in the type described in the publication mentioned above, are especially susceptible. For example, acorn barnacles attach themselves so firmly that they have to be cut away.

In a known type of outboard drive of the kind indicated above, sealing surfaces around the exhaust outlet in the mounting means lie directly in front of sealing surfaces around the exhaust outlet in the underwater housing when moving straight ahead. When large steering deflections are performed, however, the exhaust outlet, and thus parts of the sealing surfaces as well, will be at least partly exposed, the exhaust gases through the exhaust outlet being blown out at least in part at the side of the exhaust inlet in the underwater housing. When putting-in manoeuvres are performed, great rudder deflections are often necessary, and, if the boat is left with a great steering deflection of the underwater housing after putting-in, the sealing surfaces are accessible to fouling which after a relatively long time, for example a month, can become extensive, which leads to greater steering force from the steering machinery being necessary and to the power consumption, the wear and the service requirement increasing.

The object of the present invention is to produce an outboard drive of the kind referred to in the introduction which eliminates the problem of fouled sealing surfaces around the exhaust outlet and inlet.

According to the invention, this is achieved by virtue of the fact that the said exhaust outlet is surrounded by a surface layer which counteracts fouling by organisms present in the water and that the control unit is arranged so as, on a given control command, via the power-operated means, to put the underwater housing in a predetermined position in which a surface of the underwater housing, which surface faces the exhaust outlet and surrounds the said exhaust inlet, lies within the surrounding boundary of the said surface layer.

By, in accordance with a preferred embodiment of the invention, arranging a sheet of Teflon® (polytetrafluoroethylene) which covers that region of the mounting means facing the underwater housing between the end positions of the underwater housing and having the engine control unit for a drive engine coupled to the drive give a control command to the control unit of the drive to put the drive in a position halfway between these end positions, that is to say the position for moving straight ahead, when the engine is shut off, the problems of fouling described above are eliminated automatically without the person responsible for the boat having to take any special action. Organisms such as, for example, acorn barnacles attach themselves very weakly to Teflon, The invention is described in greater detail with reference to illustrative embodiments shown in the accompanying drawing, in which FIG. 1 shows a perspective view of an embodiment of an outboard drive according to the invention, and FIG. 2 shows a longitudinal section through a part of the outboard drive in FIG. 1.

Figure 2:
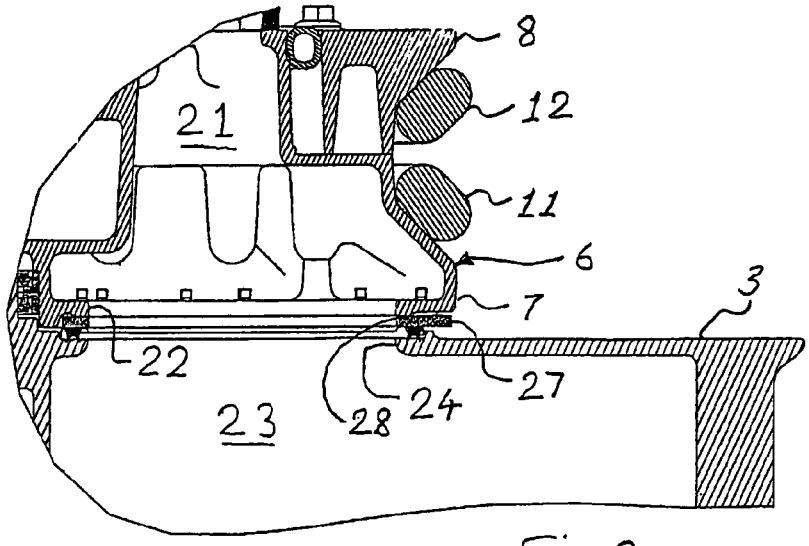

The propeller drive designated generally by 1 in FIG. 1 has a gear housing 2 enclosing a horizontal drive shaft, a vertical drive shaft and an intermediate bevel gear (not shown). The horizontal drive shaft is intended to be connected to a drive engine, and the vertical drive shaft to a vertical drive shaft (not shown) which is mounted in an underwater housing 3 and, via a bevel gear in the underwater housing 3, drives two concentric counter-rotating propeller shafts (not shown), each with a respective propeller 4 and 5.

Arranged between the upper gear housing 2 and the underwater housing 3 is a mounting element designated generally by 6 which consists of on the one hand a lower bowl-shaped housing part 7, which is connected firmly to the gear housing 2 in a way not shown in greater detail, and on the other hand an upper housing part 8 which, when the drive 1 is mounted through an opening in the bottom of a boat, is bolted to the lower housing part 7. Sealing rings 11 and 12 are arranged between conical surfaces 9 and 10 on respective housing parts 7 and 8.

The underwater housing 3 is mounted rotatably in the gear housing 2 in a known way. The rotary movement is brought about with the aid of an electric servomotor unit 13 which is assembled together with the gear housing 2 and, via an integrated planetary gear, rotates the underwater housing 3 relative to the gear housing depending on signals from an electronic control unit in the form of a control computer 14 which, in a practical embodiment, is also integrated in the servomotor unit 13. In the embodiment shown, the control computer 14 communicates with an engine control computer 15 for an internal combustion engine, for example a diesel engine, (not shown) connected to the drive.

The control computer 14 is arranged so as, on a signal from the engine control computer 15 indicating a command to stop the internal combustion engine (ignition off), to give a signal to the servomotor to put the underwater housing 3 in a position halfway between two end positions, that is to say in the straight-ahead position. FIG. 1 shows an end position at 16, when the underwater housing 3 is in a position for maximum starboard yaw, that is to say in the opposite end position.

As can be seen from FIG. 1, an exhaust pipe 20 from the internal combustion engine (not shown) is connected to the mounting element 6. The exhaust pipe 20 opens into an exhaust passage 21 (FIG. 2) which extends through the element 6 and, on the underside of the element 6, has an outlet opening 22 which, in the position shown in FIG. 1 of the underwater housing 3, is partly exposed, so that exhaust gases are blown in part directly out into the water and in part through an exhaust passage 23 in the underwater housing 3. The passage 23 has an inlet 24 which, in the position of the underwater housing for moving straight ahead, that is to say halfway between the end positions 16, lies directly in front of the outlet opening 22 in the mounting element 6. The passage 23 opens into an exhaust discharge 26 in the aft side of the underwater housing 3.

The sector between the end positions 16 on the underside of the mounting element 6 is covered by a fouling-preventing layer, preferably a plate 27 made of polytetrafluoroethylene (Teflon®), which is bolted to the mounting element 6 and has an opening 28 which coincides with the outlet opening 22. It has been found that even if water organisms, such as acorn barnacles, do after a relatively long time stationary become attached to the plate 27 on those surfaces which are not covered by the underwater housing in its straight-ahead position, they are nevertheless attached so loosely that they are easily scraped off by the underwater housing 6 when this is rotated during steering the next time the boat is taken out.

It is also conceivable, as an alternative to the model described above of having engine shut-off bring the underwater housing 3 into straight-ahead position, to arrange a separate manual control 30 which has a "parking position" in which the underwater housing is put in the straight-ahead position. A disadvantage of a separate manual control is of course that it is possible to forget to put it in the parking position just as it is also possible to forget to put it in the "off position" when starting the next time.

In a drive with the engine control function described above, which also has a brake for locking the underwater housing in the set position after the engine has been shut off, the engine control computer is also arranged so as to switch the brake off automatically via the control computer of the drive when the engine is started.

The invention claimed is:

1. Outboard drive for boats for driving at least one propeller, comprising a gear housing, an underwater housing connected rotatably to the gear housing, mounting means arranged between the gear housing and the underwater housing for mounting the drive in a boat hull with the gear housing on the inside and the underwater housing on the outside of the hull and comprising an exhaust passage, which has an exhaust outlet opening into an exhaust inlet to an exhaust passage in the underwater housing, and power-operated means which are connected to an electronic control unit and by means of which the underwater housing is rotatable relative to the gear housing and the mounting means depending on control commands fed into the control unit, wherein the exhaust outlet is surrounded by a surface layer which counteracts fouling by organisms present in the water and the control unit is arranged so as, on a given non-steering control command, via the power-operated means to put the underwater housing in a predetermined position in which a surface of the underwater housing, which surface faces the exhaust outlet and surrounds the exhaust inlet, lies within the surface layer.

2. Outboard drive according to claim 1, wherein the underwater housing is rotatable between two predetermined end positions and in that the surface layer covers the surface region between these end positions.

3. Outboard drive according to claim 2, wherein the predetermined position of the underwater housing lies halfway between the end positions.

4. Outboard drive according to claim 3, wherein the surface layer consists of polytetrafluoroethylene.

5. Outboard drive according to claim 3, wherein the control unit communicates with an engine control unit for an internal combustion engine and is arranged so as, on a signal to the engine control unit to shut off the internal combustion engine, to give a control command to the power-operated means to put the underwater housing in the predetermined position.

6. Outboard drive according to claim 3, wherein the control unit communicates with a manual control which, when operated manually, gives the control unit a control command to put the underwater housing in the predetermined position.

7. Outboard drive according to claim 3, wherein the control unit is a control computer, in which the value of the steering angle of the underwater housing relative to the gear housing in the predetermined position is stored.

8. Outboard drive according to claim 2, wherein the surface layer consists of polytetrafluoroethylene.

9. Outboard drive according to claim 2, wherein the control unit communicates with a manual control which, when operated manually, gives the control unit a control command to put the underwater housing in the predetermined position.

10. Outboard drive according to claim 2, wherein the control unit is a control computer, in which the value of the steering angle of the underwater housing relative to the gear housing in the predetermined position is stored.

11. Outboard drive according to claim 1, wherein the surface layer consists of polytetrafluoroethylene.

12. Outboard drive according to claim 11, wherein the control unit communicates with an engine control unit for an internal combustion engine and is arranged so as, on a signal to the engine control unit to shut off the internal combustion engine, to give a control command to the power-operated means to put the underwater housing in the predetermined position.

13. Outboard drive according to claim 11, wherein the control unit communicates with a manual control which, when operated manually, gives the control unit a control command to put the underwater housing in the predetermined position.

14. Outboard drive according to claim 11, wherein the control unit is a control computer, in which the value of the steering angle of the underwater housing relative to the gear housing in the predetermined position is stored.

15. Outboard drive according to claim 1, wherein the control unit communicates with a manual control which, when operated manually, gives the control unit a control command to put the underwater housing in the predetermined position.

16. Outboard drive according to claim 1, wherein the control unit is a control computer, in which the value of the steering angle of the underwater housing relative to the gear housing in the predetermined position is stored.

17. Outboard drive according to claim 1, wherein the power-operated means are an electric servomotor.

18. Outboard drive for boats for driving at least one propeller, comprising a gear housing, an underwater housing connected rotatably to the gear housing, mounting means arranged between the gear housing and the underwater housing for mounting the drive in a boat hull with the gear housing on the inside and the underwater housing on the outside of the hull and comprising an exhaust passage, which has an exhaust outlet opening into an exhaust inlet to an exhaust passage in the underwater housing, and power-operated means which are connected to an electronic control unit and by means of which the underwater housing is rotatable relative to the gear housing and the mounting means depending on control commands fed into the control unit, wherein the exhaust outlet is surrounded by a surface layer which counteracts fouling by organisms present in the water and the control unit is arranged so as, on a given control command, via the power-operated means, to put the underwater housing in a predetermined position in which a surface of the underwater housing, which surface faces the exhaust outlet and surrounds the exhaust inlet, lies within the surface layer, wherein the control unit communicates with an engine control unit for an internal combustion engine and is arranged so as, on a signal to the engine control unit to shut off the internal combustion engine, to give a control command to the power-operated means to put the underwater housing in the predetermined position.

19. Outboard drive according to claim 18, wherein the control unit is a control computer, in which the value of the steering angle of the underwater housing relative to the gear housing in the predetermined position is stored.

20. Outboard drive for boats for driving at least one propeller, comprising a gear housing, an underwater housing connected rotatably to the gear housing, mounting means arranged between the gear housing and the underwater housing for mounting the drive in a boat hull with the gear housing on the inside and the underwater housing on the outside of the hull and comprising an exhaust passage, which has an exhaust outlet opening into an exhaust inlet to an exhaust passage in the underwater housing, and power-operated means which are connected to an electronic control unit and by means of which the underwater housing is rotatable relative to the gear housing and the mounting means depending on control commands fed into the control unit, wherein the exhaust outlet is surrounded by a surface layer which counteracts fouling by organisms present in the water and the control unit is arranged so as, on a given control command, via the power-operated means, to put the underwater housing in a predetermined position in which a surface of the underwater housing, which surface faces the exhaust outlet and surrounds the exhaust inlet, lies within the surface layer, wherein the underwater housing is rotatable between two predetermined end positions and in that the surface layer covers the surface region between these end positions, wherein the control unit communicates with an engine control unit for an internal combustion engine and is arranged so as, on a signal to the engine control unit to shut off the internal combustion engine, to give a control command to the power-operated means to put the underwater housing in the predetermined position.

* * * * *